US008511354B2

(12) United States Patent
Schamberger et al.

(10) Patent No.: US 8,511,354 B2
(45) Date of Patent: Aug. 20, 2013

(54) LOG SPLITTER

(75) Inventors: Randy Schamberger, Cumberland, WI (US); Jay Engstrom, Cumberland, WI (US)

(73) Assignee: Ardisam, Inc., Cumberland, WI (US)

( * ) Notice: Subject to any disclaimer, the term of this patent is extended or adjusted under 35 U.S.C. 154(b) by 681 days.

(21) Appl. No.: 12/060,554

(22) Filed: Apr. 1, 2008

(65) Prior Publication Data

US 2009/0242078 A1 Oct. 1, 2009

(51) Int. Cl.
*B27L 7/00* (2006.01)

(52) U.S. Cl.
USPC ..... 144/193.2; 144/195.1; 144/195.6

(58) Field of Classification Search
USPC ..... 144/192, 193.1, 193.2, 195.8, 195.1, 144/194, 195.6, 195.7; 137/574
See application file for complete search history.

(56) References Cited

U.S. PATENT DOCUMENTS 3,779,295 A * 12/1973 Balsbaugh ..... 144/195.1
4,076,062 A * 2/1978 Kanik ..... 144/195.1
4,086,111 A * 4/1978 Corey ..... 144/195.1
4,278,118 A * 7/1981 Larson ..... 144/195.1
4,441,535 A * 4/1984 Flinn et al. ..... 144/4.6
4,458,737 A * 7/1984 Klug ..... 144/195.1
4,503,894 A * 3/1985 Gratkowski ..... 144/195.1
4,782,870 A * 11/1988 Duerr ..... 144/195.1
4,945,960 A * 8/1990 McCauley ..... 144/195.1
4,957,621 A * 9/1990 Rohloff ..... 210/171
6,637,457 B2 * 10/2003 Evanovich et al. ..... 137/574
7,124,794 B2 * 10/2006 Marx ..... 144/193.2
7,134,464 B2 11/2006 Walker et al.
7,255,143 B1 * 8/2007 Babcock et al. ..... 144/195.1
2005/0284541 A1 12/2005 Walker et al.

* cited by examiner

*Primary Examiner* — David Walczak
*Assistant Examiner* — Jennifer C Chiang
(74) *Attorney, Agent, or Firm* — Stoel Rives LLP

(57) ABSTRACT

A log splitter includes a trailer supporting a hydraulic pump, and a splitting beam coupled to the trailer. The splitting beam includes a housing maintaining a reservoir communicating with the hydraulic pump, and a hydraulic ram coupled to the housing, where the hydraulic ram is in communication with the reservoir and the hydraulic pump. The splitting beam is movable relative to the trailer between a first splitting position adjacent to the trailer and a second splitting position in which the splitting beam is displaced away from the trailer.

16 Claims, 10 Drawing Sheets

LOG SPLITTER

BACKGROUND

Wood is a renewable resource that is ideally suited for heating homes and businesses. The use of wood as a home heating source is likely to increase as the cost of fossil fuels increases. Typically, trees are cut down and the tree trunks and branches are split to a smaller size for burning. Since wood (especially newly sawn wood) can be heavy, it is desirable to split the wood near the location where the tree was felled. For most wood burning applications, it is desirable to split the wood to a length of less than about 2 feet for easy placement in stoves, fireplaces, camp fires, furnaces, or other wood burning devices.

Cutting trees and hauling branches out of a forest to a central wood splitting location is hard work and can be expensive. In addition, the manual labor of splitting logs takes time and can be physically taxing. For these reasons, consumers desire log splitters that are easy to transport and to use.

SUMMARY

One aspect provides a log splitter including a trailer supporting a hydraulic pump, and a splitting beam coupled to the trailer. The splitting beam includes a housing maintaining a reservoir communicating with the hydraulic pump, and a hydraulic ram coupled to the housing; the hydraulic ram in communication with the reservoir and the hydraulic pump. The splitting beam is movable relative to the trailer between a transport/first splitting position adjacent to the trailer and a second elevated splitting position in which the splitting beam is displaced away from the trailer.

Another aspect provides a log splitter including a hydraulic pump and a splitting beam. The splitting beam includes a housing maintaining a reservoir communicating with the hydraulic pump, a baffle inserted into the housing separating the reservoir into an inlet volume and an outlet volume, and a hydraulic ram coupled to the housing. The hydraulic ram communicates with the reservoir and the hydraulic pump.

Another aspect provides a method of fabricating a transportable log splitter. The method includes attaching a hydraulic pump to a trailer, and attaching a splitting beam to the trailer, the splitting beam communicating with the hydraulic pump. The method additionally includes configuring the splitting beam to be movable between a first position adjacent to the trailer and a second position elevated away from the trailer.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

In this specification, the phrases "comprising a . . . " and "comprising an . . . " are each to mean a set including one or more.

Embodiments provide a transportable log splitter that includes a splitting beam attached to a trailer, where the splitting beam is moveable between a first low center of gravity position adjacent to the trailer to a second splitting position displaced away from the trailer. Embodiments of the transportable log splitter provide a trailer configured for easy towing behind a vehicle, such as an all terrain vehicle, where the trailer also includes a hitch for pulling a separate trailer to haul the split logs. The second splitting position provides an elevated splitting surface that is easy to reach and minimizes bending and stretching by the user.

Embodiments of the splitting beam include a housing defining a reservoir and a baffle inserted into the reservoir that is configured to maximize mixing of hydraulic fluid entering the reservoir to dissipate heat in the hydraulic fluid. The baffle provides highly effective mixing of the hydraulic fluid in the reservoir and is relatively inexpensive to manufacture.

Figure 1:
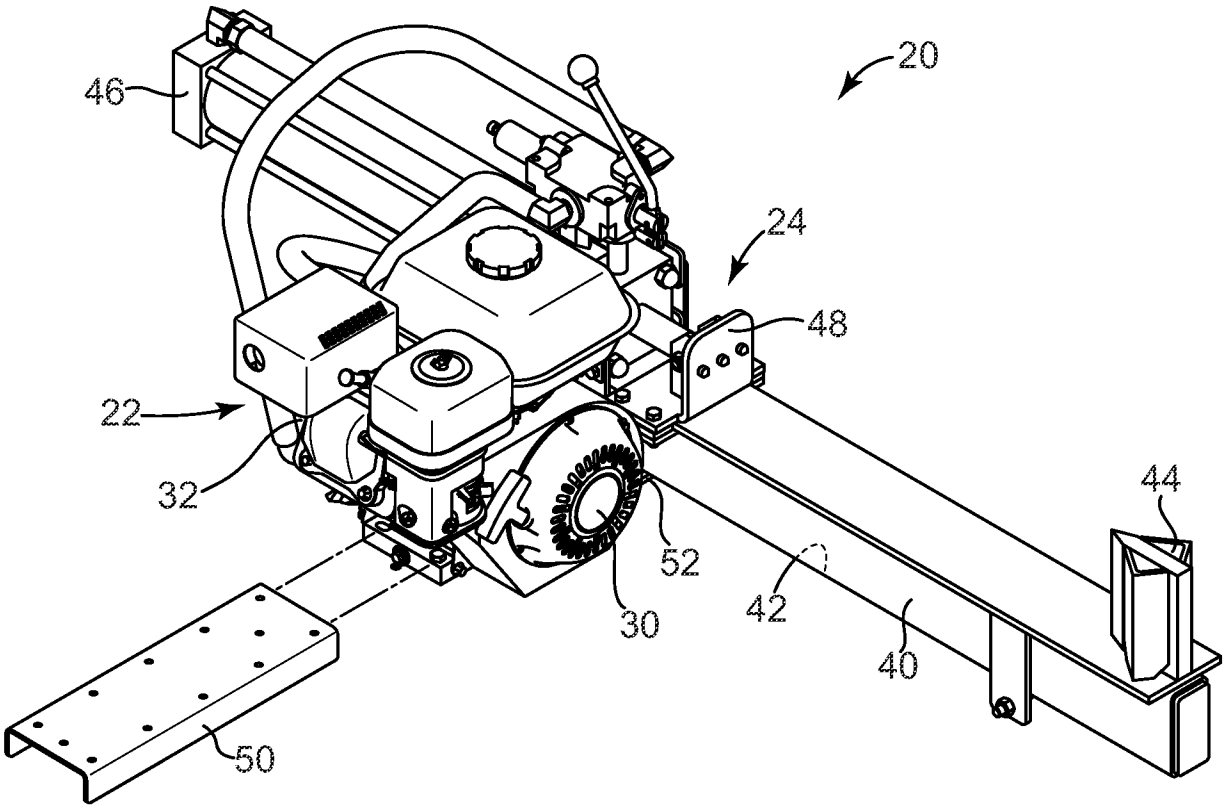
FIG. 1 is a perspective view of a log splitter including a hydraulic pump assembly attached to a splitting beam according to one embodiment.

FIG. 1 is a perspective view of a log splitter 20 according to one embodiment. Log splitter 20 is provided as a stand alone splitter and includes a hydraulic pump assembly 22 coupled to a splitting beam 24. Hydraulic pump assembly 22 includes an engine 30 operating a hydraulic pump 32 (see FIG. 2) that is connected to splitting beam 24. Splitting beam 24 includes a housing 40 defining an internal reservoir 42, a wedge 44 fixed to one end of housing 40, and a hydraulic cylinder 46 operating a ram 48 that is attached to housing 40 opposite wedge 44. Hydraulic pump 32 communicates with both reservoir 42 and cylinder 46, as described below. In one embodiment, log splitter 20 is self-contained and engine 30 is mounted to housing 40 by an engine support 50 that is attachable to a plate 52 extending from housing 40. In other embodiments, log splitter 20 is provided as part of a transportable system and engine support 50 and engine 30 are mounted to a platform separate from splitting beam 24.

Figure 2:
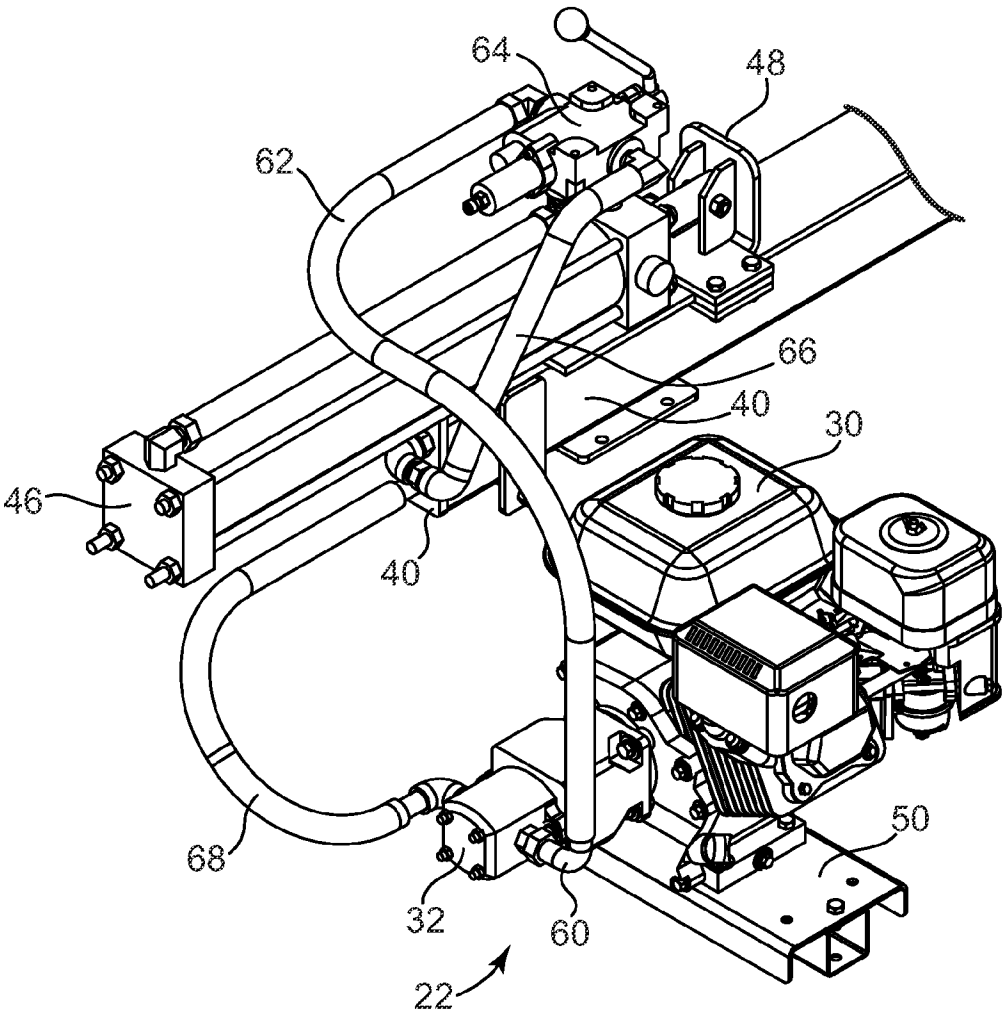
FIG. 2 is a perspective view of the hydraulic pump assembly shown in FIG. 1.

FIG. 2 is a perspective view of hydraulic pump assembly 22. Hydraulic cylinder 46 is included in the view and shown attached to pump assembly 22. Engine 30 is mounted to engine support 50 and drives hydraulic pump 32, which hydraulically operates ram 48. In one embodiment, engine 30 includes a 196 cc, 4-cycle gas powered engine available from Briggs and Stratton, Wauwatosa, Wis. Other suitable engines are also acceptable.

In one embodiment, hydraulic pump 32 includes an outlet 60, a hydraulic hose 62 coupled between outlet 60 and a valve assembly 64, a low pressure hydraulic hose 66 coupled between valve assembly 64 and reservoir 42 inside housing 40, and a suction line 68 that returns fluid from reservoir 42 back to hydraulic pump 32. In one embodiment, hydraulic pump 32 includes a single stage 4 gallon-per-minute hydraulic pump operating a 12 ton ram 48, although other pump sizes and ram tonnages are acceptable.

Figure 3:
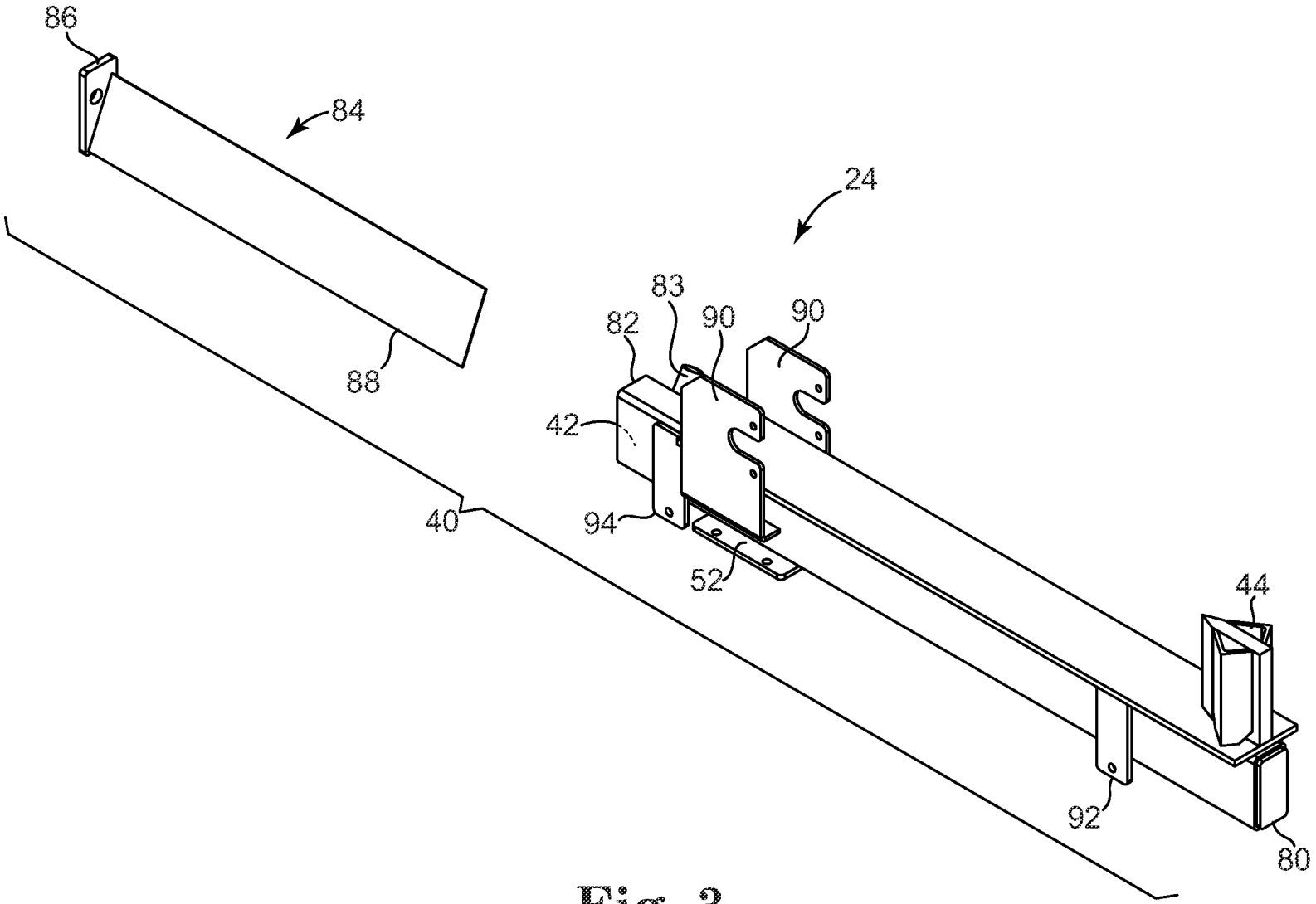
FIG. 3 is an exploded perspective view of a portion of the splitting beam shown in FIG. 1.

FIG. 3 is an exploded perspective view of a portion of splitting beam 24. Hydraulic cylinder 46 and ram 48 (FIG. 1) have been removed from splitting beam 24 for ease of illustration. In one embodiment, splitting beam 24 includes a tubular housing 40 enclosing reservoir 42, where housing 40 has a first sealed end 80 opposite a second end 82 and a fill spout 83 communicating with reservoir 42. Baffle 84 is insertable into housing 40 and includes an end plate 86 configured to seal second end 82 of housing 40 and a blade 88 extending from end plate 86.

In one embodiment, housing 40 includes a bracket 90 attached adjacent to second end 82 and opposite of wedge 44. Bracket 90 provides opposing ears that are sized to receive/support hydraulic cylinder 46 (FIG. 1) and axially position ram 48 opposite wedge 44. When so aligned, cylinder 46 is hydraulically operable to drive ram 48 toward wedge 44. In another embodiment, a splitting wedge is attached to ram 48 and configured to be driven against a stationary support to split a log positioned between the wedge/ram 48 and the support.

In an optional embodiment, housing 40 includes a first trunnion 92 coupled adjacent to first end 80 and a second trunnion 94 attached to housing 40 adjacent to second end 82. Trunnions 92, 94 are provided to optionally and movably couple splitting beam 24 to a trailer as provided in embodiments described below.

Housing 40 is fabricated to provide an internal sealed reservoir 42. Housing 40, wedge 44, and bracket 90 are fabricated from a suitable material such as metal. For example, in one embodiment housing 40 is fabricated from ASTM A513 rectangular steel tubing and wedge 44, end plate 86, and bracket 90 are steel components welded to housing 40. Other suitable materials for fabricating housing 40 are also acceptable.

Blade 88 is insertable into housing 40 to separate reservoir 42 into an inlet volume and an outlet volume as described below. In one embodiment, blade 88 is a rectangular piece of solid metal. Other embodiments of blade 88 include one or more holes formed in blade 88 to assist in mixing of hydraulic fluid inside reservoir 42. For example, one embodiment of blade 88 includes an array of holes, where the holes are sized to assist in the efficient mixing and cooling of the hydraulic fluid inside of reservoir 42. Blade 88 is fabricated of materials that are impervious to hydraulic fluid, and some suitable materials include metals such as steel or plastics.

Figure 4:
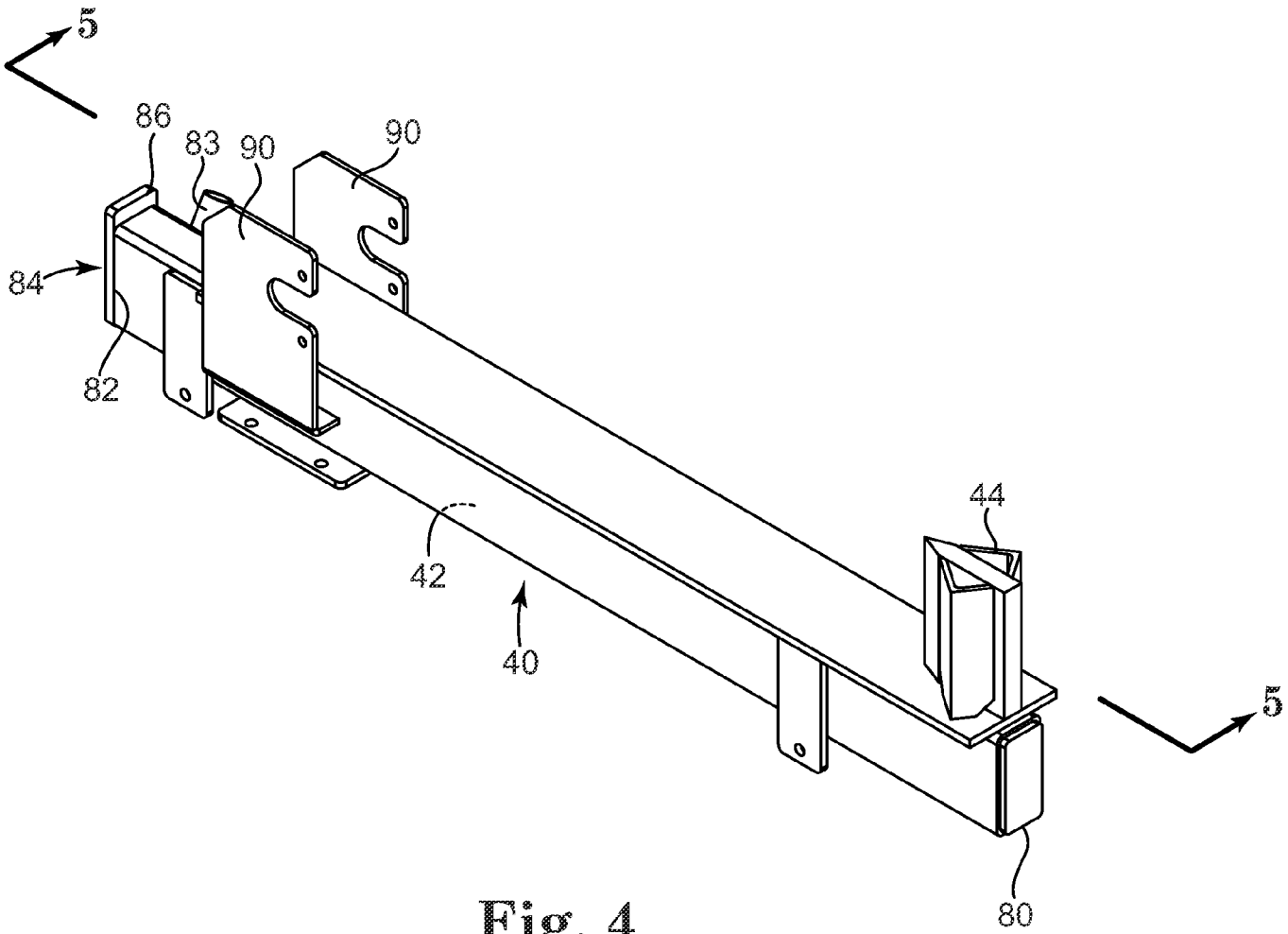
FIG. 4 is a perspective view of the splitting beam shown in FIG. 3 as assembled.

FIG. 4 is a perspective view of housing 40 as assembled. Baffle 84 extends into tubular housing 40 and end plate 86 is sealed against second end 82. In this manner, housing 40 is sealed on ends 80, 82 to provide a sealed reservoir 42 for hydraulic fluid. The hydraulic fluid level inside reservoir 42 is adjusted by adding or removing fluid from spout 83. Bracket 90 provides an anchor to which cylinder 46 (FIG. 1) is attached.

Figure 5:
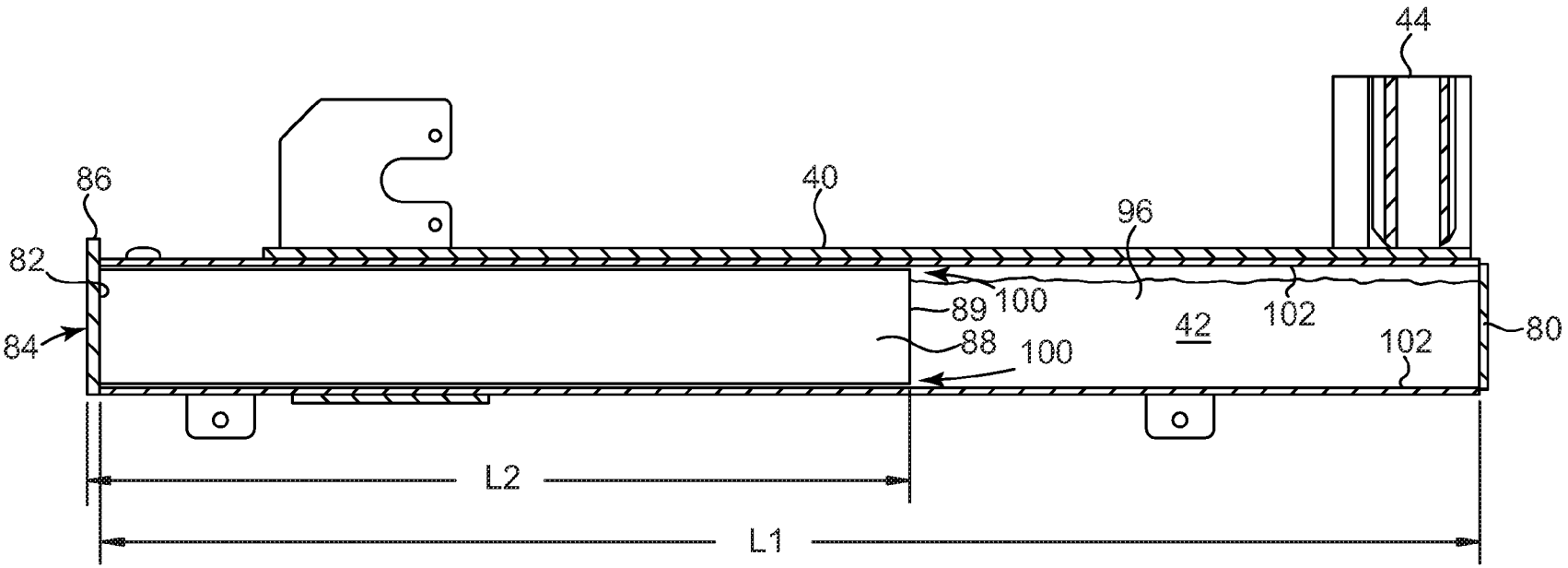
FIG. 5 is a cross-sectional view of the splitting beam taken along line 5-5 of FIG. 4.

FIG. 5 is a cross-sectional view of housing 40 taken along line 5-5 in FIG. 4. Hydraulic fluid 96 is contained by housing 40. Reservoir 42 inside housing 40 provides a total fluid volume of about 6 quarts and extends a length L1 between first end 80 and second end 82. Baffle 84 has a length L2 extending between end plate 86 and a leading end 89 of blade 88. In one embodiment, baffle length L2 is less than the length L1 of reservoir 42, and preferably L2 is between about 20-95% of L1. Other volume capacities for reservoir 42 and relative sizes between baffle 84 and reservoir length L1 are also acceptable.

Reservoir 42 is sized such that when baffle 84 is inserted into housing 40, a clearance 100 is provided between blade 88 and an interior wall 102 of housing 40. In this manner, baffle 84 is less expensive to manufacture since close tolerance fitting and attachment of blade 88 to interior wall 102 is mitigated. In one embodiment, clearance 100 is sized to a dimension of between about 0.050-0.10 inches such that most of the hydraulic fluid 96 within reservoir 42 is directed around the leading end 89 of blade 88 instead of through clearance 100. Baffle 84 separates hot incoming hydraulic fluid 96 entering reservoir 42 from cooler hydraulic fluid 96 exiting reservoir 42. Some amount of hydraulic fluid 96 possibly flows through clearance 100, but most of the hydraulic fluid 96 is directed around blade 88 to ensure thorough mixing of the hydraulic fluid 96 within reservoir 42.

Figure 6:
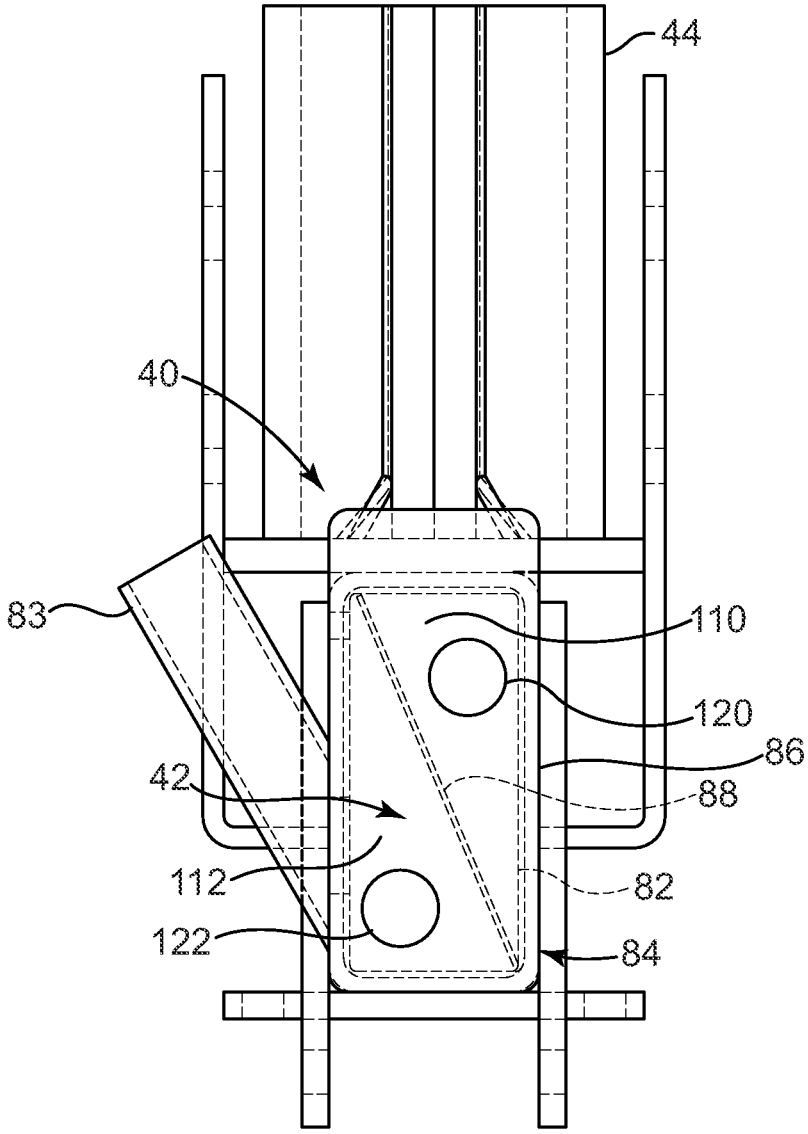
FIG. 6 is an end view of the splitting beam shown in FIG. 5.

FIG. 6 is an end view of housing 40. End plate 86 of baffle 84 is sealed to second end 82 of housing 40 and blade 88 of baffle 84 separates reservoir 42 into an inlet volume 110 and an outlet volume 112. The volume of hydraulic fluid inside reservoir is adjusted by adding/removing fluid via spout 83. Blade 88 is oriented diagonally within reservoir 42, although other orientations are also acceptable. In one embodiment, end plate 86 defines a threaded inlet port 120 communicating with inlet volume 110 and a threaded outlet port 122 communicating with outlet volume 112.

With additional reference to FIG. 2, low pressure return hose 66 directs heated hydraulic fluid from valve assembly 64 into inlet port 120. Blade 88 of baffle 84 segregates the heated hydraulic fluid to the inlet volume 110 side of reservoir 42. The heated hydraulic fluid within the inlet volume 110 side of reservoir 42 mixes and cools as it moves around blade 88 to the outlet volume 112 side of reservoir 42. Suction hose 68 is coupled between outlet port 122 and hydraulic pump 32 to deliver relatively cool hydraulic fluid from reservoir 42 to hydraulic pump 32. Suitable couplings are employed to connect hydraulic hoses 66, 68 to respective inlet and outlet ports 120, 122. In one embodiment, inlet port 120 and outlet port 122 are sized for ½ inch couplings, although other coupling sizes are also acceptable.

Blade 88 of baffle 84 extends diagonally within reservoir 42 formed by housing 40. Other orientations for blade 88 are also acceptable, such as horizontal blades disposed within reservoir 42, vertical blades disposed within reservoir 42, or other combinations of curved or linear mixing blades separating reservoir 42 into an inlet volume and an outlet volume. In all embodiments, baffle 84 effectively separates the hot hydraulic fluid entering inlet port 120 of reservoir 42 from outlet port 122, which provides generally cooler hydraulic fluid to hydraulic pump 32 to minimize the wear on the seals and valve assemblies of pump 32.

Figure 7:
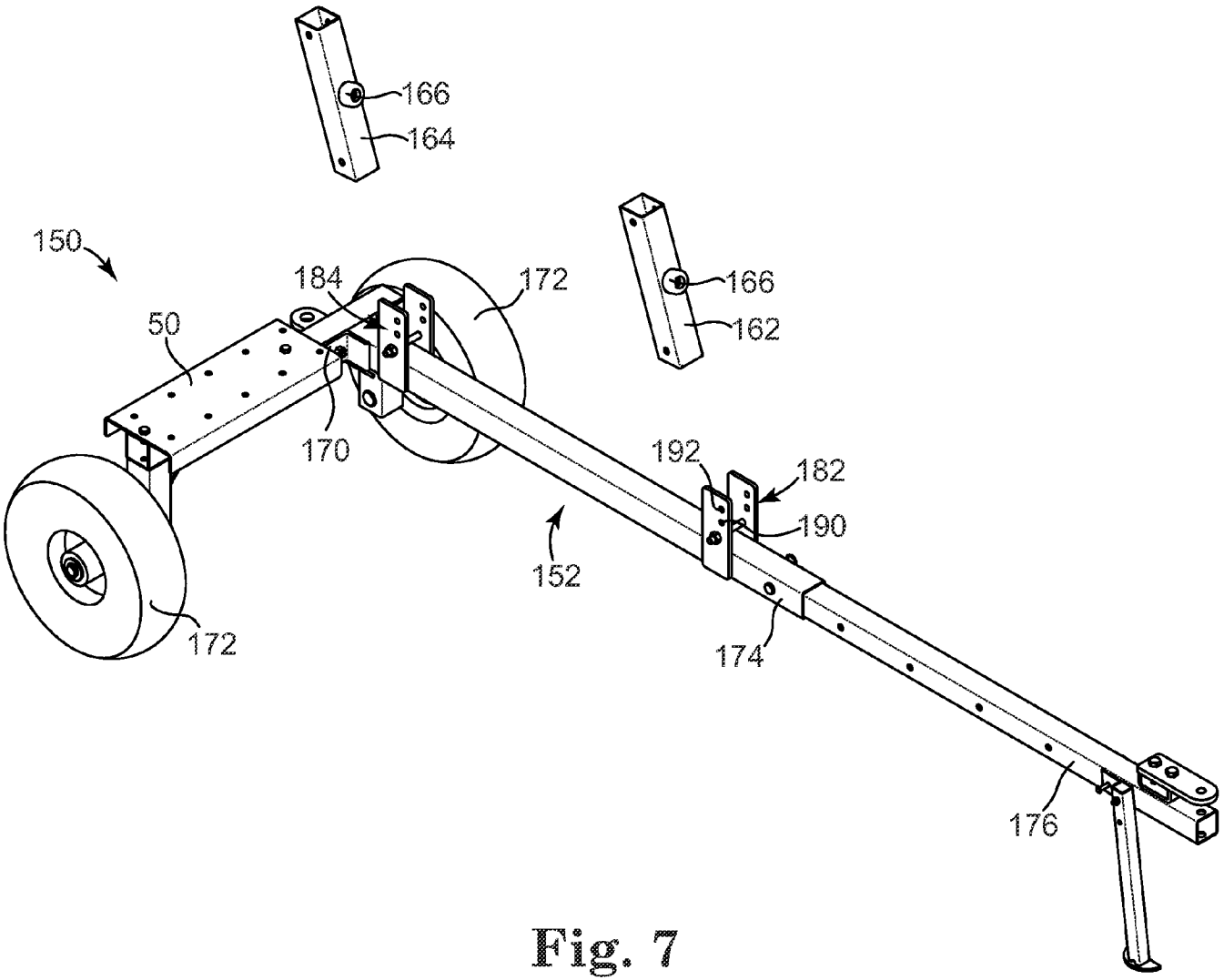
FIG. 7 is a perspective view of a trailer according to one embodiment that is configured to haul the log splitter shown in FIG. 1.

FIG. 7 is a perspective view of a trailer 150 according to one embodiment that is configured to haul log splitter 20 shown in FIG. 1. Trailer 150 includes a frame 152 supporting spaced apart risers 162, 164, and an axel 170 supporting opposing wheels 172. Risers 162, 164 are mounted between frame 152 and log splitter 20 (FIG. 1) to enable the splitting beam 24 to pivot/move between a first position adjacent to frame 152 and a second position in which splitting beam 24 is displaced away and off set from frame 152. Bumpers 166 are attached to risers 162, 164 to elevate risers 162, 164 off of frame 152 when risers 162, 164 are folded in a down position. To this end, bumpers 166 enable the risers 162, 164 to deploy away from frame 152 and provide vibration damping when trailer 150 is transported.

In one embodiment, a cross-beam axel 170 supports opposing wheels 172, a first frame section 174 extends from axel 170, a tongue 176 is coupled to first frame section 174, and spaced trunnions 182, 184 are coupled to first frame section 174. In one embodiment, engine support 50 is attached to cross-beam axel 170 to support hydraulic pump assembly 22 including engine 30 (FIG. 1). In one embodiment, tongue 176 is configured to telescope within first frame section 174 to enable the selective lengthening of frame 152 to accommodate hitches on different towing vehicles.

Trunnions 182, 184 provide opposing projections that are configured to couple about opposing sides of respective risers 162, 164. A bottom portion of the risers 162, 164 are pinned between the projections on the respective trunnions 182, 184 such that the risers 162, 164 pivot in the plane of frame 152. A top portion of the risers 162, 164 connect to splitting beam 24 (FIG. 1). In one embodiment, each trunnion 182, 184 is provided with up-position locking bores 190 and down-position locking bores 192. Up-position locking bores 190 are configured to receive a pin that locks risers 162, 164, respectively, in an upward extended position. Downward locking bores 192 are configured to receive a pin that locks risers 162, 164, respectively, in the collapsed downward position.

Figure 8:
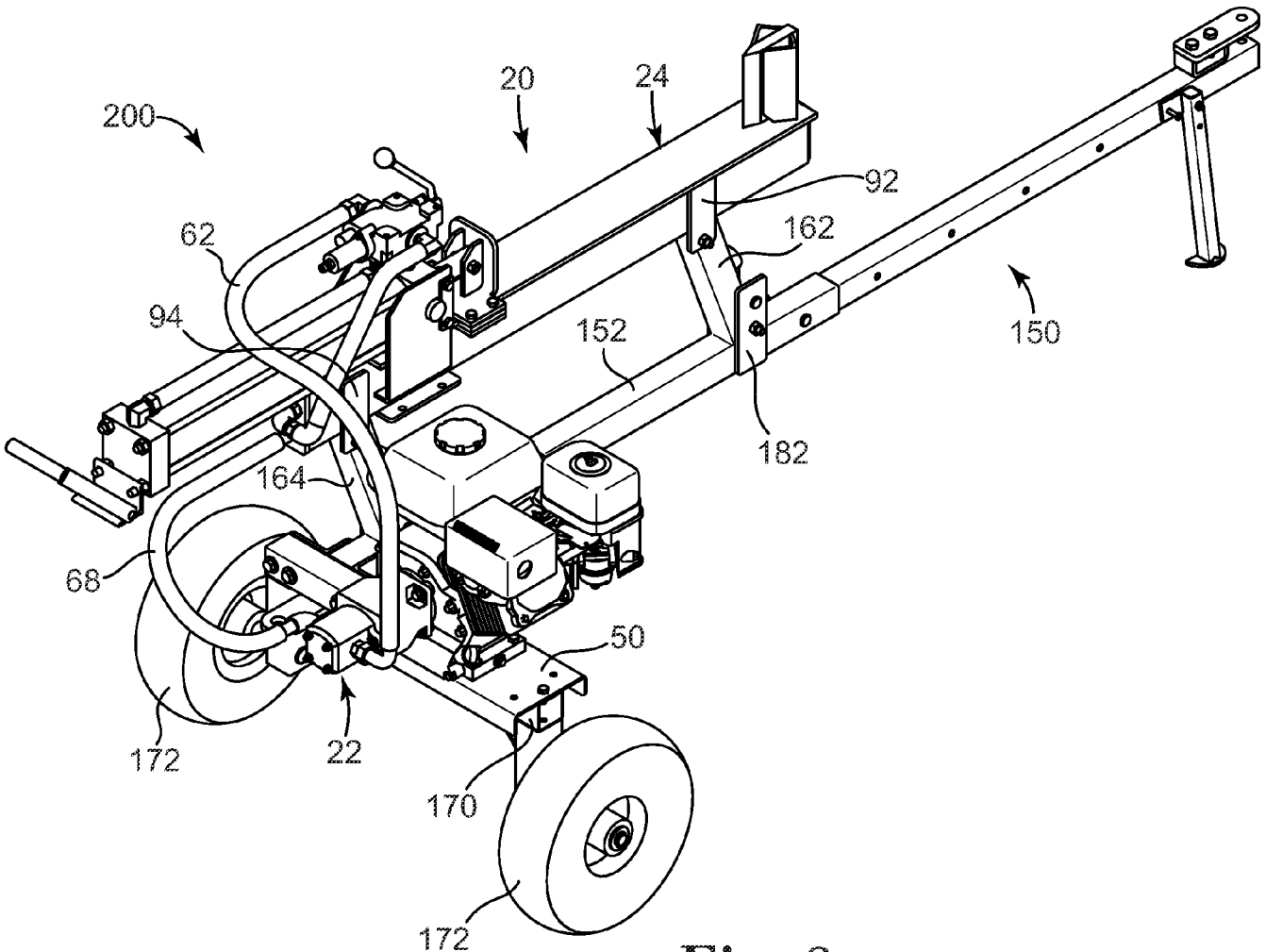
FIG. 8 is a perspective view of the log splitter shown in FIG. 1 mounted to the trailer shown in FIG. 7.

FIG. 8 is a perspective view of a mobile log splitter 200 including log splitter 20 attached to trailer 150. Hydraulic pump assembly 22 is attached to engine support 50 that is attached to axel 170. Splitting beam 24 is attached to trailer 150 by rises 162, 164. In particular, riser 162 extends between trunnion 92 of splitting beam 24 and trunnion 182 attached to trailer 150, and riser 164 is attached between trunnion 94 of splitting beam 24 and trunnion 184 attached to trailer 150. Log splitter 20 is shown in an elevated splitting position in which splitting beam 24 is displaced off of and elevated away from frame 152 of trailer 150. The elevated splitting position is ideally suited for log splitting while minimizing the distance that the user stoops or bends down to the working surface.

Figure 9:
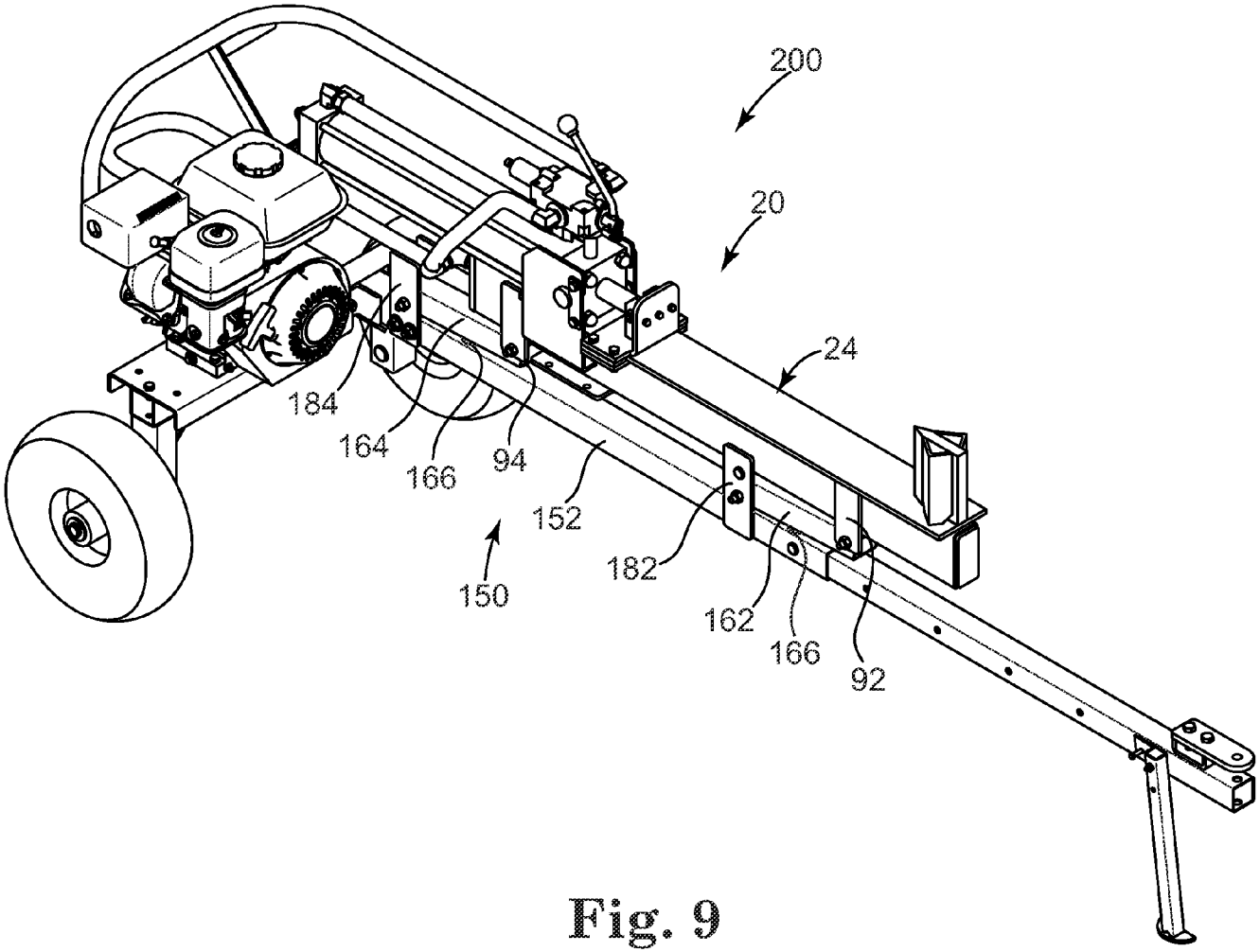
FIG. 9 is a perspective view of the log splitter shown in FIG. 8 with the splitting beam folded down or collapsed onto the trailer.

FIG. 9 is a perspective view of mobile log splitter 200 having splitting beam 24 deployed to a collapsed position adjacent to frame 152 of trailer 150. Risers 162, 164 have pivoted downward relative to frame 152 and splitting beam 24 has collapsed to a down position along side and adjacent to frame 152. In this configuration, mobile log splitter 200 provides a lower center of gravity useful when pulling mobile log splitter 200 behind a vehicle. Bumpers 166 elevate risers 162, 164 off of frame 152 to enable splitting beam 24 to be easily rotated up and off of frame 152 to the position illustrated in FIG. 8.

Figure 10:
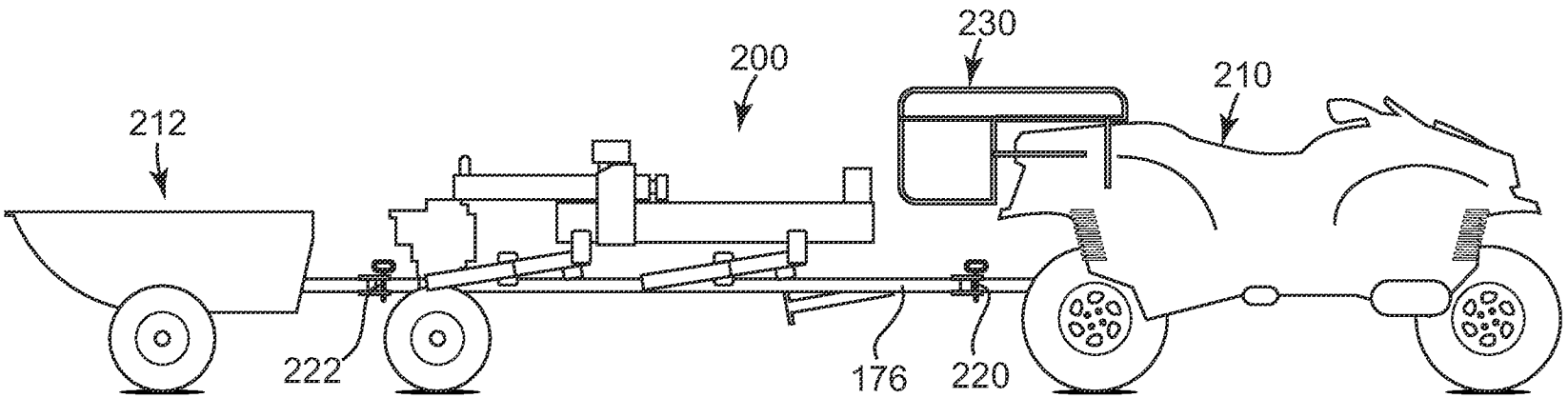
FIG. 10 is a side view of the log splitter and trailer shown in FIG. 9 attached between an all terrain vehicle and a separate second trailer.

FIG. 10 is a side view of mobile trailer 200 coupled between a vehicle 210 and a separate trailer 212. Tongue 176 is attached to a hitch 220 of vehicle 210 and trailer 212 is attached to mobile log splitter 200 by hitch 222. In one embodiment, vehicle 210 is an all terrain vehicle including an accessory basket 230, and telescoping tongue 176 is extended to couple to hitch 220 and provide clearance between mobile log splitter 200 and accessory basket 230. In this manner, mobile log splitter 200 is configured to be towed by vehicle 210 along with trailer 212 that is suited for hauling split logs.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments of log splitters as discussed herein. Therefore, it is intended that this invention be limited only by the claims and the equivalents thereof.

What is claimed is:

1. A log splitter comprising:

a trailer supporting a hydraulic pump, the trailer comprising a central longitudinal axis; and a splitting beam movably coupled to the trailer by a coupling structure, the coupling structure permitting the splitting beam to move relative to the trailer between a first splitting position parallel to the central longitudinal axis of the trailer and a second splitting position in which the splitting beam is displaced above and away from and parallel to the central longitudinal axis of the trailer, the splitting beam comprising:

a housing maintaining a reservoir communicating with the hydraulic pump, a hydraulic ram coupled to the housing, the hydraulic ram communicating with the reservoir and the hydraulic pump to operably drive the hydraulic ram toward a wedge.

2. The log splitter of claim 1, wherein the splitting beam comprises a baffle insertable into the housing and configured to separate the reservoir into a hydraulic fluid inlet volume and a hydraulic fluid outlet volume.

3. The log splitter of claim 2, wherein the housing comprises a tubular housing having first and second opposing ends, the first end sealed, and the baffle comprises an end plate that is sealed to the second end of the tubular housing.

4. The log splitter of claim 3, wherein the end plate of the baffle defines an inlet port communicating with the hydraulic fluid inlet volume and an outlet port communicating with the hydraulic fluid outlet volume.

5. The log splitter of claim 2, wherein the housing comprises a housing length and the baffle comprises a baffle length that is between about 20-95% of the housing length.

6. The log splitter of claim 1, wherein the splitting beam comprises a first trunnion coupled adjacent to a first end of the housing and a second trunnion coupled adjacent to a second end of the housing, the first and second trunnions coupled to respective first and second risers that are pivotably coupled to the trailer.

7. The log splitter of claim 6, wherein the trailer comprises a length-adjustable tongue.

8. The log splitter of claim 6, wherein the risers each comprise a bumper attached to an exterior surface, the bumper configured to contact the trailer when the splitting beam is in the first splitting position adjacent to the trailer.

9. The log splitter of claim 1 wherein the coupling structure comprises a pair of risers that form a parallelogram structure between the splitting beam and the trailer.

10. The log splitter of claim 1 wherein the splitting beam is parallel to the trailer in both the first and second splitting positions.

11. A log splitter comprising:

a trailer supporting a hydraulic pump, the trailer comprising a central longitudinal axis; and a splitting beam comprising:

a coupling structure movably coupling the splitting beam to the trailer, the coupling structure permitting the splitting beam to move relative to the trailer between a first splitting position parallel to the central longitudinal axis of the trailer and a second splitting position in which the splitting beam is displaced above and away from and parallel to the central longitudinal axis of the trailer, a housing maintaining a reservoir communicating with the hydraulic pump, a baffle inserted into the housing effectively separating the reservoir into an inlet volume and an outlet volume, wherein the baffle comprises an end plate and a blade extending from the end plate, a hydraulic ram coupled to the housing and communicating with the reservoir and the hydraulic pump to operably drive the hydraulic ram toward a wedge.

12. The log splitter of claim 11, wherein the hydraulic pump is operated by an engine coupled to the housing.

13. The log splitter of claim 11, further comprising:

a trailer, the splitting beam movably coupled to the trailer between a first position in which the splitting beam is collapsed onto the trailer and a second position in which the splitting beam is displaced away from the trailer;

wherein the hydraulic pump is operated by an engine coupled to the trailer.

14. The log splitter of claim 11, wherein the end plate is connected to the housing and the blade is not connected to the housing.

15. The log splitter of claim 11, wherein the housing comprises a tubular housing sealed on a first end and sealed on a second end opposite the first end by the end plate of the baffle.

16. The log splitter of claim 11, wherein the end plate defines an inlet port communicating with the inlet volume and an outlet port communicating with the outlet volume, a low pressure return line of the hydraulic ram coupled with the inlet port and a suction line coupled between the outlet port and an intake of the hydraulic pump.

* * * * *